US008644739B2

(12) United States Patent
Ichikawa

(10) Patent No.: US 8,644,739 B2
(45) Date of Patent: Feb. 4, 2014

(54) TONER CARTRIDGE AND IMAGE FORMING APPARATUS INCLUDING THE SAME

(75) Inventor: Yoshiki Ichikawa, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 261 days.

(21) Appl. No.: 13/197,181

(22) Filed: Aug. 3, 2011

(65) Prior Publication Data

US 2012/0033999 A1 Feb. 9, 2012

(30) Foreign Application Priority Data

Aug. 5, 2010 (JP) ..... 2010-176240

(51) Int. Cl.
*G03G 15/08* (2006.01)

(52) U.S. Cl.
USPC ..... 399/258; 399/262

(58) Field of Classification Search
USPC ..... 399/106, 258, 262, 263
See application file for complete search history.

(56) References Cited

U.S. PATENT DOCUMENTS 7,167,668 B2 1/2007 Sekiguchi
2009/0257785 A1 * 10/2009 Okuda et al. ..... 399/263

FOREIGN PATENT DOCUMENTS

JP 2000-214667 8/2000
JP 2005-049673 A 2/2005
JP 2005-62844 3/2005

OTHER PUBLICATIONS

Okura et al. (JP 2005-049673 A; Feb. 2005) JPO Machine Translation.*

* cited by examiner

*Primary Examiner* — Walter L Lindsay, Jr.
*Assistant Examiner* — Erika J Villaluna
(74) *Attorney, Agent, or Firm* — Nixon & Vanderhye, P.C.

(57) ABSTRACT

A toner cartridge comprising:
- a cartridge body that has a toner discharge port on an one end side in its longitudinal direction;
- a shutter for opening and closing the toner discharge port;
- a screw-shaped shaft for conveying a toner in the cartridge body to the toner discharge port;
- a paddle member for conveying the toner in the cartridge body toward the screw-shaped shaft; and
- a toner inflow block member coupled to a portion of the paddle member.

9 Claims, 8 Drawing Sheets

TONER CARTRIDGE AND IMAGE FORMING APPARATUS INCLUDING THE SAME

CROSS-REFERENCE TO RELATED APPLICATION

This application is related to Japanese patent application No. 2010-176240 filed on Aug. 5, 2010 whose priority is claimed under 35 USC §119, the disclosure of which is incorporated by reference in its entirety.

BACKGROUND OF THE INVENTION

1. Field of the Invention

The present invention relates to a toner cartridge replaceably attached to an electrophotographic image forming apparatus, and to an image forming apparatus including the same.

2. Description of the Related Art

Conventionally, electrophotographic image forming apparatuses such as copiers, printers, and facsimile machines, which use dual-component developers, are each capable of continuously driving to output images by being automatically supplied with a toner from a toner discharge port of a toner cartridge replaceably attached to an apparatus body to a developing section of the apparatus.

As shown in FIG. 10, what has been proposed as such a toner cartridge 300 is the one including: a toner cartridge body 301 having a toner discharge port 304*a*; a shutter 303 provided on the outer surface side of the toner cartridge body 301 for opening and closing the toner discharge port 304*a*; an auger screw 302 rotatably provided in the toner cartridge body 301 for conveying a toner T in the toner cartridge body 301 to the toner discharge port 304*a*; and a paddle member 306 rotatably provided in the toner cartridge body 301 so as to be in parallel to a rotary shaft 302*a* of the auger screw 302 for conveying the toner T in the toner cartridge body 301 toward the auger screw 302, in which the toner discharge port 304*a* is disposed on one end side in a longitudinal direction of the toner cartridge body 301.

As a device that resembles the toner cartridge shown in FIG. 10, what has been proposed is the one disclosed in Japanese Unexamined Patent Publication No. 2000-214667, for example.

In a case where the toner cartridge 300 shown in FIG. 10 is kept upright with the toner discharge port 304*a* facing downward, the toner T in the toner cartridge body 301 sinks down under its own weight over the course of time, and hence a toner density around the toner discharge port 304*a* becomes high. As a result, there arises a problem that the toner T around the toner discharge port 304*a* flocculates, and eventually forms lumps, to clog the toner discharge port 304*a*. It is to be noted that any part in FIG. 10 where black dots appear densely represents such a flocculated toner T or a lump of the toner T.

While the manufacturers recommend users not to store the toner cartridge 300 in such the upright state, in some cases, this is not complied with.

Depending on vibrations or load conditions of the toner cartridge 300 during transportation, the toner density around the toner discharge port 304*a* may become high to result in the flocculation. As a result, toner discharge port 304*a* is clogged with such a flocculated toner T or lumps of the toner T. Therefore, when the toner cartridge 300 whose toner discharge port 304*a* is clogged is attached to the apparatus body of the image forming apparatus, the toner T is not easily discharged from the toner cartridge 300. This may cause the apparatus body to determine that the toner has run out, even when a large amount of the toner T remains in the toner cartridge 300.

Further, the flocculated toner T or lumps of the toner T around the toner discharge port 304*a* may be compressed and thus solidifies under the pressure of the auger screw 302, resulting in a failure of the auger screw 302 being locked.

Accordingly, as to an attachment of a new toner cartridge to the apparatus body, the manufacturers recommend the users to follow a precaution of shaking the toner cartridge for several times before attaching it. However, in some cases, this is not complied with.

Further, because a recent toner has its fusing performance under low temperatures improved for the energy-saving purpose, its storage stability is reduced, and hence such a toner is prone to the toner flocculation when left at an ambient temperature.

Still further, in accordance with the miniaturization demanded for recent image forming apparatuses, the toner cartridge also is subjected to miniaturization, and hence the toner cartridge body is tightly packed with the toner. Therefore, the toner flocculation is prone to occur.

The toner cartridge disclosed in Japanese Unexamined Patent Publication No. 2000-214667 is directed to prevent the toner flocculation by partially cutting a helical blade of the auger screw on the toner discharge port side, so as to reduce the pressure applied by the auger screw to the toner on the toner discharge port side when the toner is conveyed. However, this cannot address the toner flocculation that occurs when the toner cartridge is stored in such the upright state with the toner discharge port facing downward.

SUMMARY OF THE INVENTION

The present invention has been made to solve the problem described above, and an object thereof is to provide a toner cartridge with which flocculation of a toner on a toner discharge port side is prevented, which would otherwise occur depending on storage conditions, and an image forming apparatus including the same.

Accordingly, the present invention provides: a toner cartridge, comprising:

- a toner storage-purpose cartridge body that is formed in a shape of a hermetic container elongated in one direction, and that has a toner discharge port on an one end side in a longitudinal direction thereof;
- a shutter provided on an outer surface side of the cartridge body for opening and closing the toner discharge port;
- a screw-shaped shaft provided in the cartridge body rotatably about a rotation axis in the longitudinal direction for conveying a toner in the cartridge body to the toner discharge port;
- a paddle member having in the cartridge body a rotary shaft being in parallel to the rotation axis of the screw-shaped shaft and an agitating blade attached to the rotary shaft, for conveying the toner in the cartridge body toward the screw-shaped shaft; and
- a toner inflow block member coupled to a portion of the paddle member, wherein
- the toner cartridge body includes a toner storage section being a large-capacity space where the paddle member is disposed and the toner is stored; and a toner conveying passage being a small-capacity space where the screw-shaped shaft is disposed, the toner conveying passage being adjacent to and communicating with the toner storage section and having the toner discharge port disposed on an one end side in a longitudinal direction of the toner conveying passage, the toner inflow block member is disposed at a block position where an inflow of the toner toward the toner discharge port is blocked, so as to cover a portion of the screw-shaped shaft in a state before the cartridge body is attached to an image forming apparatus, and rotates with the paddle member with the cartridge body attached to the image forming apparatus so as to be away from the block position.

According to the present invention, even when the toner cartridge is kept upright with the toner discharge port facing downward, thanks to the toner inflow block member, the toner will not easily flow into the space on the toner discharge port side of the toner conveying passage. Therefore, even when the toner cartridge is stored for a long period of time in this state, the toner is prevented from flocculating around the toner discharge port.

This holds true to a situation where the toner cartridge is shaken during transportation.

As a result, it becomes possible to solve the problems of an erroneous detection made by the apparatus body of the image forming apparatus that the toner has run out, and the screw-shaped shaft being locked and failed.

Further, after the toner cartridge is attached to the apparatus body and when the toner is supplied from the toner cartridge to the developing section of the image forming apparatus, the toner inflow block member rotates with the paddle member so as to be away from the block position. Therefore, the space of the toner conveying passage on the toner discharge port side is automatically opened, and the toner can be conveyed by the screw-shaped shaft to the toner discharge port.

That is, a special mechanism for opening the toner inflow block member can be dispensed with, and the toner cartridge of a compact design can be provided.

DETAILED DESCRIPTION OF THE PREFERRED EMBODIMENTS

Figure 1:
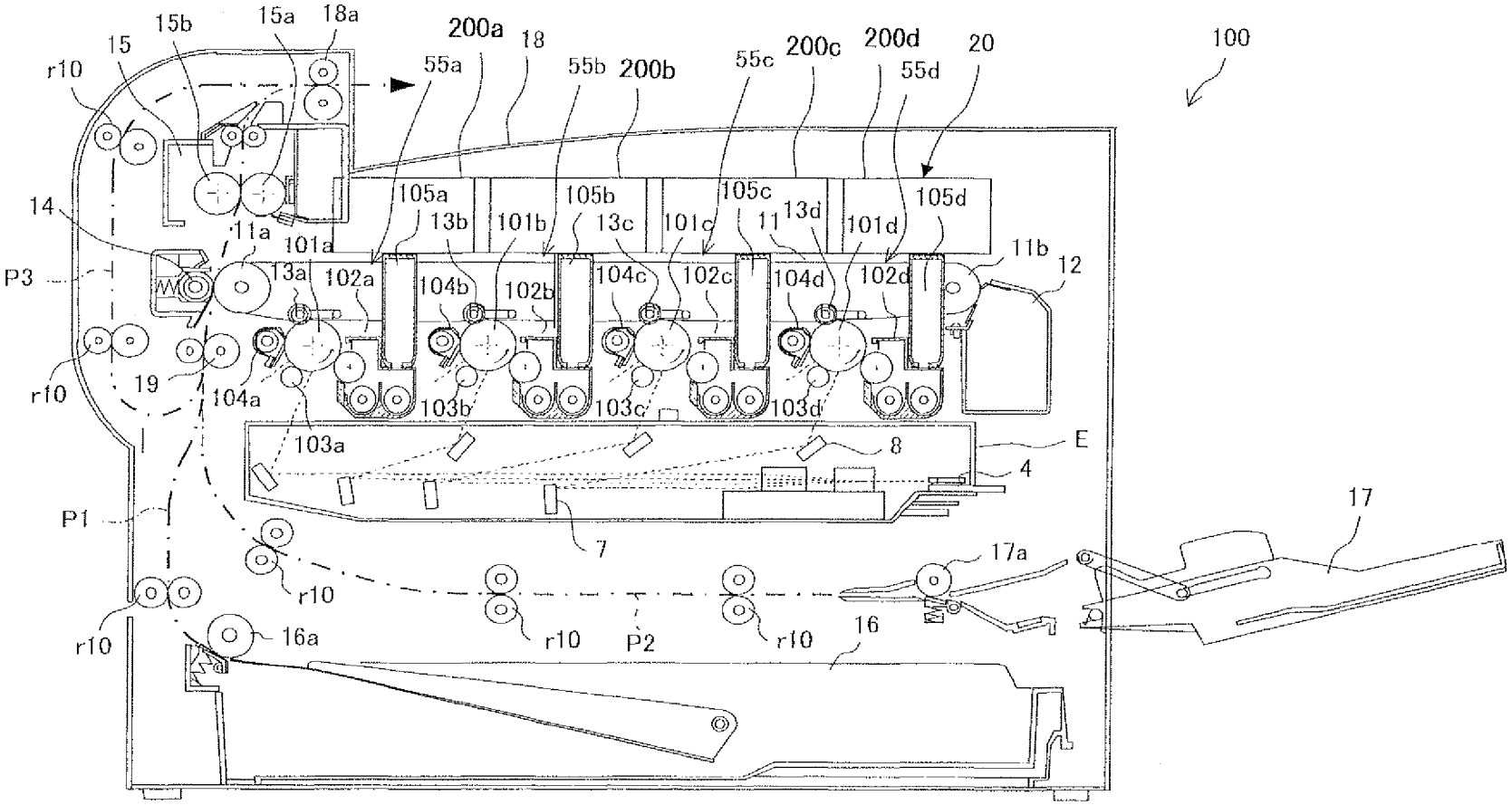
FIG. 1 is an explanatory illustration showing an overall structure of an image forming apparatus according to a first embodiment of the present invention.

The toner cartridge according to the present invention includes, as described above: the toner storage-purpose cartridge body having the toner discharge port on one end side in the longitudinal direction; the shutter for opening and closing the toner discharge port; the screw-shaped shaft for conveying the toner in the cartridge body to the toner discharge port; the paddle member for conveying the toner in the cartridge body toward the screw-shaped shaft; and the toner inflow block member. The toner cartridge is removably (replaceably) attached to an apparatus body of an electrophotographic image forming apparatus such as a copier, a printer, a facsimile machine, and a multi function peripheral possessing these functions, all of which are capable of forming a monochrome or full-color image.

Further, the toner cartridge may be structured in the following modes, which may be used in combination.

(1) The toner cartridge body is formed into a shape in which the toner conveying passage projects toward the one end side in the longitudinal direction farther than the toner storage section does, the toner discharge port is disposed in a projection space of the toner conveying passage projecting toward the one end side in the longitudinal direction farther than the toner storage section does, and the block position of the toner inflow block member is located at an opening of the projection space, the opening facing the toner storage section.

This mode makes it possible to dispose the toner inflow block member at an effective block position with respect to any existing toner cartridge body in which the toner discharge port is disposed in the projection space. As a result, in the toner cartridge before being attached to the apparatus body of the image forming apparatus, an inflow of the toner toward the toner discharge port can more effectively be blocked, and hence the toner flocculation around the toner discharge port can more effectively be prevented.

(2) The toner inflow block member includes a tip covering section covering a portion of the screw-shaped shaft, and a flexible coupling section that couples the tip covering section to a rotary shaft of the paddle member.

In this manner, it becomes possible to block the toner from flowing toward the toner discharge port of the toner conveying passage, and it becomes easier for the toner inflow block member to leave the screw-shaped shaft.

The toner inflow block member can specifically be structured as follows.

(2-1) The toner inflow block member is made of a two-ply flexible sheet or a single piece of twofold flexible sheet, wherein by coupling one end of the two-ply flexible sheet or a folded portion of the single piece of twofold flexible sheet to the rotary shaft of the paddle member, a coupled end side of the flexible sheet appearing to be two sheets becomes the flexible coupling section, and a non-coupled end side becomes the tip covering section.

(2-2) The flexible coupling section is made of one end portion that extends in a radial direction of the agitating blade in the paddle member, the tip covering section is made of a two-ply flexible sheet or a single piece of twofold flexible sheet, wherein one end of the two-ply flexible sheet or a folded portion of the single piece of twofold flexible sheet is coupled to a tip of the one end portion of the agitating blade.

(2-3) The tip covering section is made of an elastic cap having a C-shaped cross section, and the flexible coupling section is made of a strap or a tape.

These modes (2-1), (2-2) and (2-3) each achieve a simplified structure of the toner inflow block member, and each achieve a structure in which the toner inflow block member having left the screw-shaped shaft will not interfere with the screw-shaped shaft and the paddle member.

Further, with the mode (2-1), because the screw-shaped shaft can be wrapped around by two flexible sheets, it becomes possible to shorten the length of the flexible sheet than when the screw-shaped shaft is wrapped around by one flexible sheet. As a result, a frictional resistance that is produced when the toner inflow block member (i.e., flexible sheets) rotates and slidably brought into contact with an inner surface of the toner storage section can be suppressed.

Still further, with the mode (2-2), because the agitating blade of the paddle member can be used as the flexible coupling section of the toner inflow block member, the further simplified toner inflow block member can be obtained.

Still further, with the mode (2-3), because the rotation of the paddle member allows the rotary shaft of the paddle member to take up the flexible coupling section (the strap or the tape) of the toner inflow block member, whereby the tip covering section (elastic cap) is pulled toward the rotary shaft side, it becomes possible to eliminate the frictional resistance caused by the tip covering section being slidably brought into the inner surface of the toner storage section.

In the following, with reference to the drawings, a description will be given of embodiments of the present invention. It is to be noted that the present invention is not limited to the following embodiments.

First Embodiment

FIG. 1 is an explanatory illustration showing an overall constitution of an image forming apparatus according to a first embodiment of the present invention.

As shown in FIG. 1, an image forming apparatus 100 according to the first embodiment includes four image forming sections 55 (55*a* to 55*d*), and characterized in that it employs toner cartridges 200 (200*a* to 200*d*), whose description will be given later, respectively provided to the image forming sections 55.

It is to be noted that, in the first embodiment, the description will be given of an exemplary printer that forms a multi-color or single-color image as a visible image on a prescribed sheet (recording paper) based on image data included in an input command such as image data transmitted from outside via a communication network. However, the image forming apparatus may be any one of a copier, a facsimile machine, and a multi function peripheral possessing their functions, each of which is capable of forming a multi-color or single-color image on a recording medium based on image data transmitted from outside and/or image data read by a scanner from an original text.

<Overall Constitution of Image Forming Apparatus>

First, the overall constitution of the image forming apparatus 100 will be detailed.

As shown in FIG. 1, the image forming apparatus 100 according to the first embodiment includes an exposure unit E, the four image forming sections 55 (55*a* to 55*d*), an intermediate transfer belt 11, primary transfer rollers 13 (13*a* to 13*d*), a secondary transfer roller 14, a fusing device 15, sheet conveying paths P1, P2, and P3, a sheet feed cassette 16, a manual sheet feed tray 17, a sheet exit tray 18, a toner cartridge unit 20, and the like.

The image forming sections 55 (55*a* to 55*d*) respectively include photoconductor drums 101 (101*a* to 101*d*) each corresponding to an image bearer on which a latent image is formed by the exposure unit E, developing devices 102 (102*a* to 102*d*), charge rollers 103 (103*a* to 103*d*), cleaner units 104 (104*a* to 104*d*), and the like.

Image data of a multi-color image handled by the image forming apparatus 100 corresponds to four hues of black (K), cyan (C), magenta (M), and yellow (Y), based on which image data a visible image is formed by the image forming sections 55 (55*a* to 55*d*).

Accordingly, in order to form four types of latent images corresponding to respective colors, the image forming sections 55 (55*a* to 55*d*) are each provided with corresponding one of the developing devices 102 (102*a* to 102*d*), corresponding one of the photoconductor drums 101 (101*a* to 101*d*), corresponding one of the charge rollers 103 (103*a* to 103*d*), corresponding one of the transfer rollers 13 (13*a* to 13*d*), and corresponding one of the cleaner units 104 (104*a* to 104*d*).

The image forming sections 55 (55*a* to 55*d*) are arranged to form a line in a shift direction (sub-scan direction) of the intermediate transfer belt 11.

It is to be noted that, because the image forming sections 55*a* to 55*d* are of the same constitution, in the present description, the image forming sections may collectively be denoted by a uniform reference numeral 55; the photoconductor drums respectively provided to the image forming sections may collectively be denoted by a uniform reference numeral 101; the developing devices may collectively be denoted by a uniform reference numeral 102; the charge rollers may collectively be denoted by a uniform reference numeral 103; the transfer rollers may collectively be denoted by a uniform reference numeral 13; and the cleaner units may collectively be denoted by a uniform reference numeral 104. Further, as to the reference characters "a" to "d", "a" corresponds to black; "b" corresponding to cyan; "c" corresponding to magenta; and "d" corresponding to yellow. The aforementioned means identified by such reference characters constitute respectively four image forming stations.

The exposure unit E serving as an exposure device includes a not-shown semiconductor laser, a polygon mirror 4, first reflection mirrors 7, and second reflection mirrors 8, and the like, so as to irradiate the photoconductor drums 101*a* to 101*d* with light beams such as laser beams modulated by image data pieces of the respective hues, namely, black, cyan, magenta, and yellow. On the photoconductor drums 101*a* to 101*d*, there are formed electrostatic latent images based on the image data pieces of the respective hues, namely, black, cyan, magenta, and yellow.

In the present embodiment, the exposure unit E is of a scheme using a laser scanning unit (LSU) including a laser emitter and the reflection mirrors. However, there may be employed a different scheme which uses arrays of light emitting elements, such as EL and LED writing heads.

The photoconductor drums 101 each serve as a substantially cylindrical image bearer are disposed above the exposure unit E. The photoconductor drums 101 are each controlled to rotate in a prescribed direction by driving means and control means, each of which is not shown.

The photoconductor drums 101 are each structured to include a base formed with a metal drum made of, for example, aluminum or the like, and a thin-film photoconductive layer overlaid on an outer circumferential surface of the base, the thin-film photoconductive layer being made of amorphous silicon (a-Si), selenium (Se), organic photoconductor (OPC) or the like. It is to be noted that the constitution of each of the photoconductor drums 101 is not particularly limited thereto.

The charge rollers 103 are each a contact type charger that uniformly electrifies the surface of the photoconductor drum 101 at a prescribed potential.

As shown in FIG. 1, though the contact roller-type charge rollers 103 are used as the chargers in the first embodiment, a discharging type or brush-type charger may be used in place of each of the charge rollers 103.

The developing devices 102 each supply a toner on the surface of the corresponding one of the photoconductor drums 101 where an electrostatic latent image is formed, so as to develop the electrostatic latent image into a toner image.

The developing devices 102*a* to 102*d* store therein toners in black, cyan, magenta, and yellow, respectively, and visualize the electrostatic latent images formed on the photoconductor drums 101*a* to 101*d* corresponding to the respective hues into toner images in black, cyan, magenta, and yellow.

The cleaner units 104 each remove and collect, by using a lubricant or the like, the toner remaining on the surface of the corresponding one of the photoconductor drums 101 after the development and image transfer processes are carried out.

The intermediate transfer belt 11 disposed above the photoconductor drums 101 is a film having a thickness of about 100 to 150 μm, which is formed in an endless manner. The intermediate transfer belt 11 is suspended in a tensioned state between a drive roller 11*a* and a driven roller 11*b* respectively disposed downstream and upstream in a toner image conveying direction, to form a loop-like shift path.

The photoconductor drums 101 facing a bottom outer circumferential surface of the intermediate transfer belt 11 are disposed in order of the photoconductor drum 101*d*, the photoconductor drum 101*c*, the photoconductor drum 101*b*, and the photoconductor drum 101*a*, from the upstream side in the toner image conveying direction.

On a bottom inner circumferential surface side of the intermediate transfer belt 11, there are disposed the primary transfer rollers 13*a* to 13*d* pressing the bottom outer circumferential surface of the intermediate transfer belt 11 to the photoconductor drums 101*a* to 101*d* while abutting on the bottom inner circumferential surface of the intermediate transfer belt 11. The contact positions on the intermediate transfer belt 11 with respect to the photoconductor drums 101*a* to 101*d* serve as primary transfer positions.

To each of the primary transfer rollers 13*a* to 13*d*, a primary transfer bias whose polarity is opposite to the polarity of the electrostatic charge on the toner is applied under a constant voltage control, so as to transfer the toner images borne on the surfaces of the photoconductor drums 101*a* to 101*d*.

Thus, the toner image of the respective hues formed on the photoconductor drums 101*a* to 101*d* are successively transferred one over another on the outer circumferential surface of the intermediate transfer belt 11, to form a full-color toner image on the outer circumferential surface of the intermediate transfer belt 11.

However, in a case where image data of only a part of the hues of yellow, magenta, cyan, and black is input, the electrostatic latent image and the toner image are formed only on one of the photoconductor drums 101 corresponding to the hue of the input image data, out of the four photoconductor drums 101*a* to 101*d*.

For example, in a monochrome image formation mode, the electrostatic latent image and the toner image are formed only on the photoconductor drum 101*a* corresponding to the black hue, and only the black toner image is transferred to the outer circumferential surface of the intermediate transfer belt 11.

The primary transfer rollers 13*a* to 13*d* are each constituted with a shaft made of metal (e.g., stainless steel) having a diameter of 8 to 10 mm and a conductive elastic material (e.g., EPDM, foamed polyurethane or the like) coated on a surface of the shaft. With the conductive elastic material, a high voltage is uniformly applied to the intermediate transfer belt 11.

In the present embodiment, though the primary transfer rollers 13*a* to 13*d* are used as transfer electrodes, other elements such as brushes can alternatively be used.

The toner images transferred to the outer circumferential surface of the intermediate transfer belt 11 at the primary transfer positions are each conveyed by the rotation of the intermediate transfer belt 11 to a secondary transfer position which faces the secondary transfer roller 14.

In an image forming mode, the secondary transfer roller 14 is pressed against the outer circumferential surface of the intermediate transfer belt 11 wrapped around the drive roller 11*a* at a prescribed nip pressure. In order to constantly obtain the nip pressure, one of the secondary transfer roller 14 and the drive roller 11*a* is made of a hard material such as metal, and the other is made of a soft material such as an elastic roller (e.g., an elastic rubber roller, a foamed resin roller, or the like).

When the sheet fed from the sheet feed cassette 16 or the manual sheet feed tray 17 passes the secondary transfer position between the secondary transfer roller 14 and the intermediate transfer belt 11, a high voltage whose polarity is opposite (+) to the polarity (−) of the electrostatic charge on the toner is applied to the secondary transfer roller 14.

Thus, the electrostatic latent images on the photoconductor drums 101*a* to 101*d* are visualized by the toners corresponding to the respective hues, and become the toner images. The toner images are overlaid one another on the intermediate transfer belt 11. Thereafter, the resultant overlaid toner images are conveyed to the secondary transfer position by the rotation of the intermediate transfer belt 11, and the toner images are transferred on the sheet conveyed to the secondary transfer position.

The toner having not been transferred to the sheet and remaining on the intermediate transfer belt 11 causes undesired mixture of the toners in different colors in the following step. Accordingly, the remaining toner is removed and collected by an intermediate transfer belt cleaner unit 12.

The intermediate transfer belt cleaner unit 12 includes a member, for example a cleaning blade, which is brought into contact with the intermediate transfer belt 11. The cleaning blade is disposed so as to be brought into contact with a part of the outer circumferential surface of the intermediate transfer belt 11, which part is supported by the driven roller 11*b*.

The sheet on which the toner images are transferred as a visible image is guided to the fusing device 15 including a heat roller 15*a* and a pressure roller 15*b*, to pass between the heat roller 15*a* and the pressure roller 15*b* so as to undergo heating and pressurizing processes. Thus, the toner images as the visible image is firmly fused on the surface of the sheet.

Then, the sheet on which the toner images are fused is ejected by a sheet exit roller 18*a* onto the sheet exit tray 18.

In the image forming apparatus 100, the sheet conveying path P1 extending in a substantially vertical direction is provided for conveying the sheets stored in the sheet cassette 16 to the sheet exit tray 18, through between the secondary transfer roller 14 and the intermediate transfer belt 11 and via the fusing device 15.

Disposed along the sheet conveying path P1 are: a pickup roller 16*a* that picks up the sheets in the sheet cassette 16 one by one to be fed into the sheet conveying path P1; a feed roller r10 that conveys the picked up sheet upward; a registration roller 19 that guides the conveyed sheet between the secondary transfer roller 14 and the intermediate transfer belt 11 at a prescribed timing; and a sheet exit roller 18*a* that ejects the sheet to the sheet exit tray 18.

Further, in the image forming apparatus 100, the sheet conveying path P2 extending from the manual sheet feed tray 17 to the registration roller 19 is provided, along which the pickup roller 17*a* and the feed rollers r10 are disposed.

Still further, the sheet conveying path P3 is formed from the sheet exit roller 18*a* to a point upstream of the registration roller 19 in the sheet conveying path P1.

The sheet exit roller 18*a* is provided so as to be rotatable in both forward and reverse directions. The sheet exit roller 18*a* is driven in the forward direction to eject the sheet onto the sheet exit tray 18 in a simplex image forming mode in which an image is formed on one side of the sheet and in second-side image formation in a duplex image forming mode in which images are formed on both sides of the sheet.

On the other hand, in first-side image formation in the duplex image forming mode, the sheet exit roller 18*a* is driven in the forward direction until a rear end of the sheet passes through the fusing device 15, and is thereafter driven in the reverse direction while clamping the rear end of the sheet, to guide the sheet into the sheet conveying path P3. Thus, the sheet having the image formed on its one side only in the duplex image forming mode is guided to the sheet conveying path P1 in a state having its front and back surfaces as well as front and rear ends respectively reversed.

The registration roller 19 guides the sheet fed from the sheet cassette 16 or the manual sheet feed tray 17, or conveyed from the sheet conveying path P3 between the secondary transfer roller 14 and the intermediate transfer belt 11 at a timing in synchronization with the rotation of the intermediate transfer belt 11.

Accordingly, the rotation of the registration roller 19 is stopped when operations of the photoconductor drums 101 and the intermediate transfer belt 11 are started, and the sheet fed or conveyed prior to the rotation of the intermediate transfer belt 11 stops shifting in the sheet conveying path P1 in a state having its forward end abut on the registration roller 19. Thereafter, the registration roller 19 starts rotating at a timing where the forward end of the sheet and the forward ends of the toner images formed on the intermediate transfer belt 11 face each other at a position where the secondary transfer roller 14 and the intermediate transfer belt 11 are pressed against each other.

It is to be noted that, in a full-color image forming mode in which the image formation is performed at all the image forming sections 55*a* to 55*d*, the primary transfer rollers 13*a* to 13*d* press the intermediate transfer belt 11 against all the photoconductor drums 101*a* to 101*d*. On the other hand, in a monochrome image forming mode in which the image formation is performed only at the image forming section 55*a*, the primary transfer roller 13*a* solely presses the intermediate transfer belt 11 against the photoconductor drum 101*a*.

<Constitution of Toner Cartridge>

Next, with reference to the drawings, a detailed description will be given of a constitution of the characteristic toner cartridges 200 according to the first embodiment.

Figure 2:
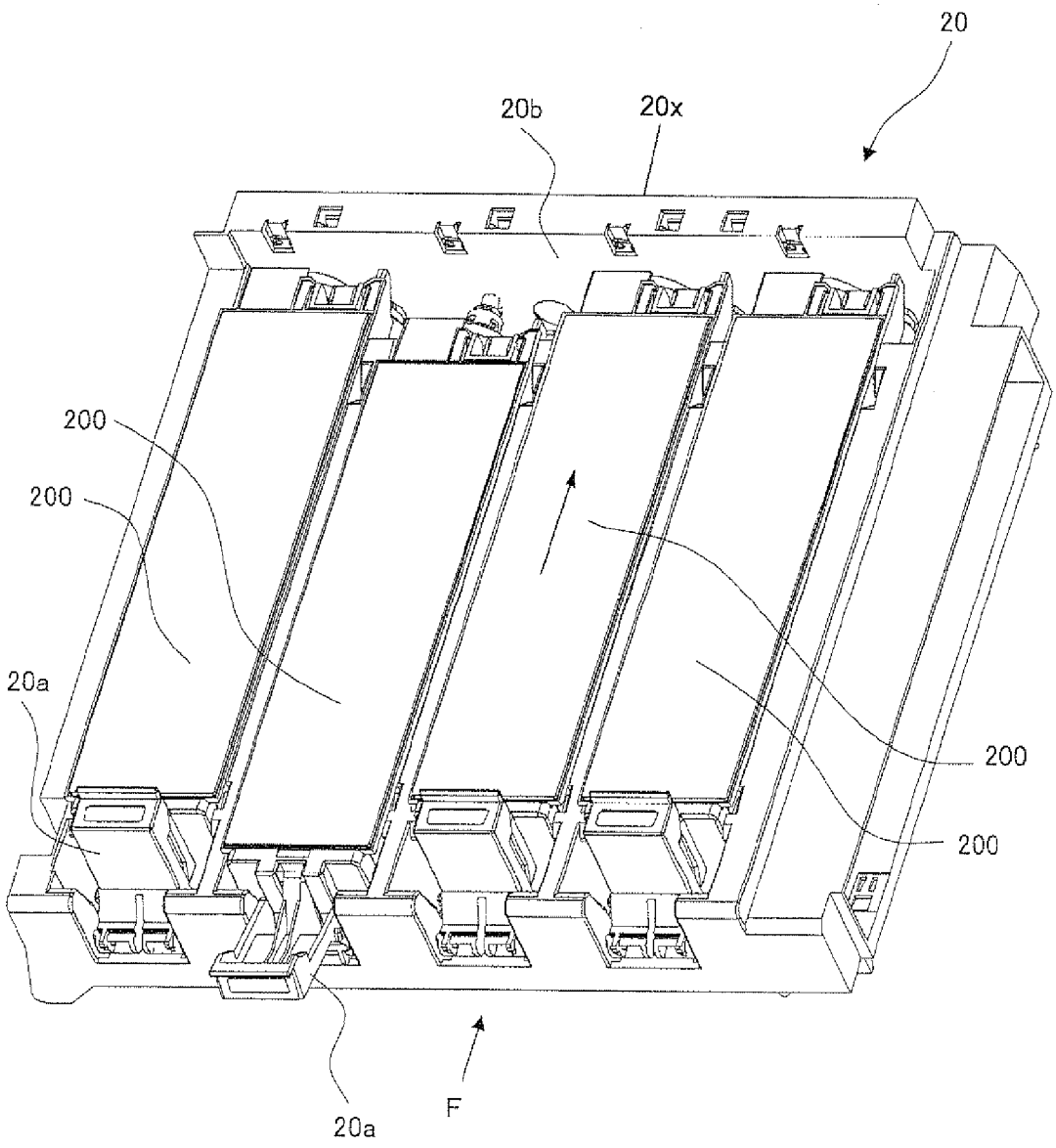
FIG. 2 is a perspective view showing a structure of a toner cartridge unit including toner cartridges, which is installed in the image forming apparatus according to the first embodiment.
Figure 3:
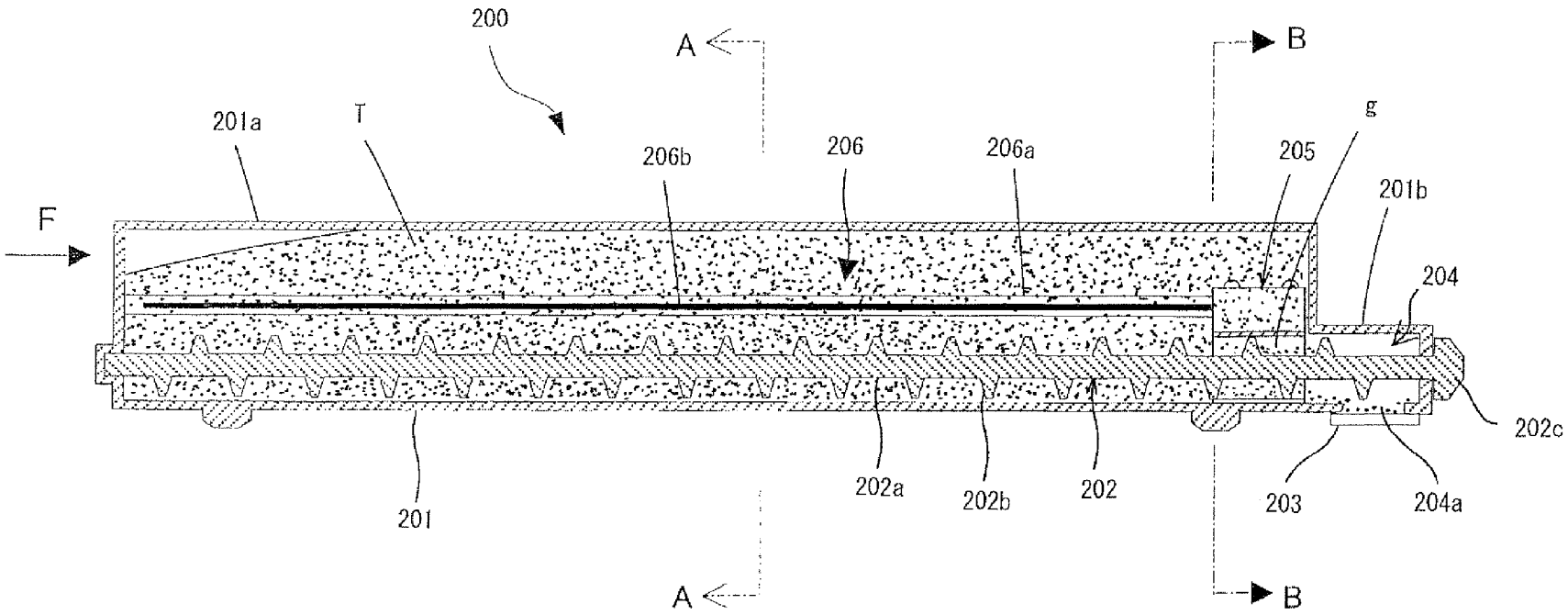
FIG. 3 is a side cross-sectional view showing a state before the toner cartridge according to the first embodiment is attached to the image forming apparatus.
Figure 4:
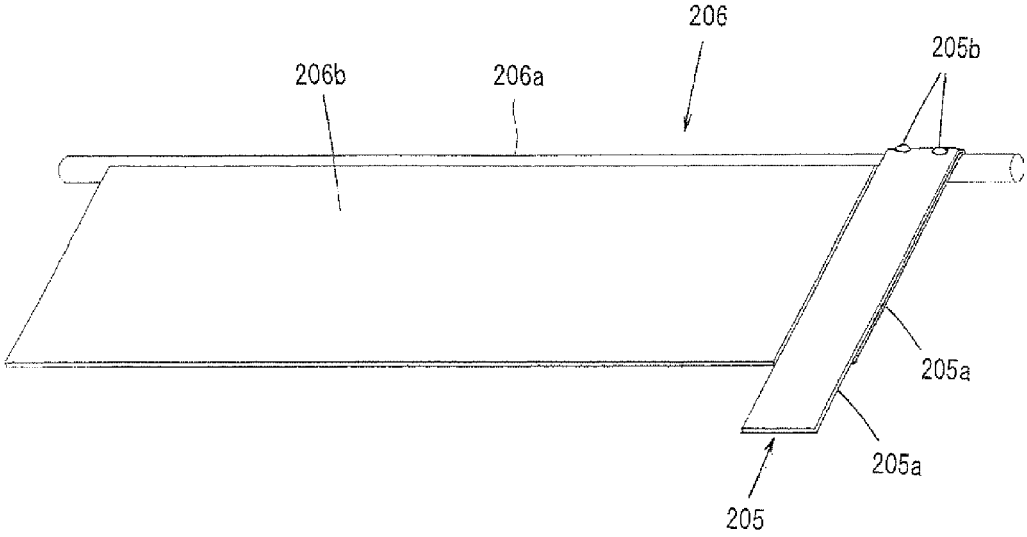
FIG. 4 is a perspective view of a paddle member and a toner inflow block member of the toner cartridge according to the first embodiment.
Figure 5:
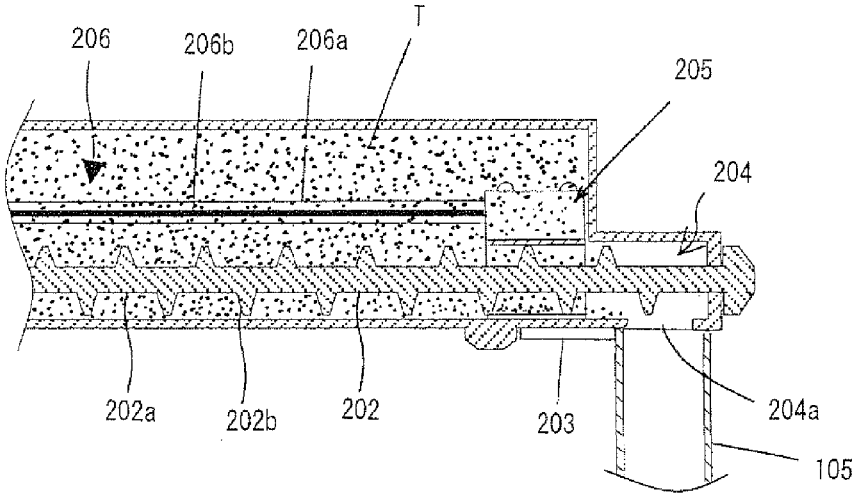
FIG. 5 is an explanatory illustration showing a state where the toner cartridge according to the first embodiment is attached to the image forming apparatus.
Figure 6A:
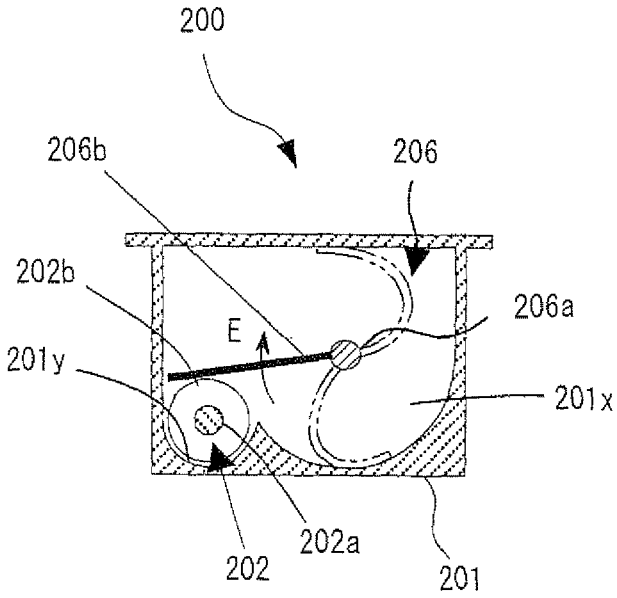
FIG. 6A is a cross-sectional view taken along line A-A of the toner cartridge shown in FIG. 3.
Figure 6B:
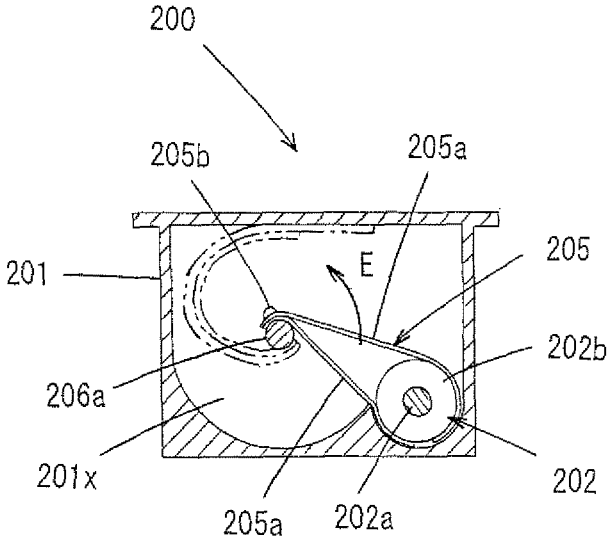
FIG. 6B is a cross-sectional view taken along line B-B of the toner cartridge shown in FIG. 3.

FIG. 2 is a perspective view showing the constitution of a toner cartridge unit including the toner cartridges, which is installed in the image forming apparatus according to the first embodiment. FIG. 3 is a side cross-sectional view showing a state before the toner cartridge according to the first embodiment is attached to the image forming apparatus. FIG. 4 is a perspective view of a paddle member and a toner inflow block member of the toner cartridge according to the first embodiment. FIG. 5 is an explanatory illustration showing a state where the toner cartridge according to the first embodiment is attached to the image forming apparatus. FIG. 6A is a cross-sectional view taken along line A-A of the toner cartridge shown in FIG. 3, and FIG. 6B is a cross-sectional view taken along line B-B of the toner cartridge shown in FIG. 3.

As shown in FIGS. 2 to 6, each of the toner cartridges 200 includes: a toner storage-purpose toner cartridge body 201 formed in a shape of a hermetic container elongated in one direction and having a toner discharge port 204*a* on one end side in the longitudinal direction; a shutter 203 provided on an outer surface side of the toner cartridge body 201 for opening and closing the toner discharge port 204*a*; a screw-shaped shaft 202 provided in the toner cartridge body 201 rotatably about a rotary axis in the longitudinal direction for conveying the toner T in the toner cartridge body 201 to the toner discharge port 204*a*; a paddle member 206 having a rotary shaft 206*a* being in parallel to a rotary shaft 202*a* of the screw-shaped shaft 202 in the toner cartridge body 201 for conveying the toner T in the toner cartridge body 201 toward the screw-shaped shaft 202; and a toner inflow block member 205 coupled to a part of the paddle member 206.

In the toner cartridge 200, the toner cartridge body 201 includes a substantially rectangular parallelepiped portion 201*a*, and a projection portion 201*b* continuously provided to one end side in the longitudinal direction of the substantially rectangular parallelepiped portion 201*a*. It is to be noted that one end of the rotary shaft 202*a* of the screw-shaped shaft 202 in the toner cartridge body 201 externally projects penetrating through a sidewall of the projection portion 201*b*, and a drive gear 202*c* is attached to the one end of the rotary shaft 202*a*.

As shown in FIG. 2, the four toner cartridges 200 are attached juxtaposed to one another to a toner cartridge holder 20*x*, to structure the toner cartridge unit 20.

The toner cartridge holder 20*x* has a shape of a top-side opened container, which has four recesses partitioned by partition walls. The toner cartridges 200 are stored in the four recesses.

Further, walls on opposite sides in the longitudinal direction of each of the recesses of the toner cartridge holder 20*x* are respectively provided with a window into which the drive gear 202C of corresponding one of the toner cartridges 200 is passed through, and a cutout to which a lock lever 20*a* is swingably attached.

By fitting the toner cartridges 200 into the recesses of the toner cartridge holder 20*x* and lifting the lock levers 20*a* of the toner cartridge holder 20X, the toner cartridge bodies 201 are shifted in the right direction (arrow F direction) and retained in a state as being pressed against a stopper plate 20*b* of the toner cartridge holder 20*x*.

Further, at a bottom wall of each of the recesses of the toner cartridge holder 20*x*, a cutout window (not shown) is formed from a position facing the toner discharge port 204*a* of corresponding one of the attached toner cartridges 200 to an edge nearby.

When the toner cartridge unit 20 is attached to the image forming apparatus, the toner cartridges 200 shift in a substantially horizontal direction relative to a toner supply pipe 105. This causes an end face of the shutter 203 to abut on a top end of the toner supply pipe 105 having passed through the cutout window, to shift the shutter 203 in the substantially horizontal direction. In this manner, the toner discharge port 204*a* is disposed at a position facing the toner supply pipe 105. Then, the toner discharge port 204*a* opens (see FIGS. 1 and 5).

It is to be noted that, the image forming apparatus is provided with a gear meshing with the drive gear on the paddle member 206 side and the drive gear on the screw-shaped shaft 202 side of each of the toner cartridges 200 to transfer torque of the drive motor.

Each of the toner cartridge bodies 201 includes therein a toner storage section 201*x* being a large capacity space where the paddle member 206 is disposed and a majority of the toner T is stored, and a toner conveying passage 201*y* being a small capacity space where the screw-shaped shaft 202 is disposed. The toner conveying passage 201*y* is adjacent to and communicates with the toner storage section 201*x*. The toner discharge port 204*a* is disposed on one end side in the longitudinal direction of the toner conveying passage 201*y*.

The one end portion in the longitudinal direction of the toner conveying passage 201*y* is an internal space of the projection portion 201*b* of the toner cartridge body 201, which serves as a toner discharge section 204 having the toner discharge port 204*a*.

That is, the toner cartridge body 201 is formed in a shape in which the toner conveying passage 201*y* projects toward the one end in the longitudinal direction than the toner storage section 201*x* does. The toner discharge port 204*a* is disposed in the a projection space of the toner conveying passage 201*y* that projects toward the one end in the longitudinal direction than the toner storage section 201*x* does.

It is to be noted that a bottom surface of the toner storage section 201*x* and that of the toner conveying passage 201*y* are each formed into an arc shape.

The toner discharge port 204*a* is a square opening provided in the bottom of the toner discharge section 204, and it discharges the toner T conveyed by the screw-shaped shaft 202 to the outside of the toner cartridge 200.

The shutter 203 is a substantially square plate-like shutter provided so as to be slidable to a position where the toner discharge port 204*a* is closed. The shutter 203 opens the toner discharge port 204*a* when the toner cartridge 200 is attached to the image forming apparatus.

In a state before the toner cartridge 200 is attached to the image forming apparatus, the shutter 203 is elastically biased in a direction to close the toner discharge port 204*a* by a not-shown spring member, for example.

The screw-shaped shaft 202 is an auger screw including the rotary shaft 202*a* and a helical blade 202*b* attached to the rotary shaft 202*a*, the helical blade 202*b* having a radial dimension so as to be accommodated inside the toner discharge section 204.

As described above, the one end of the rotary shaft 202*a* is rotatably supported, whereas the other end of the rotary shaft 202*a* is rotatably fitted into and supported by a recess provided on the sidewall on other end side in the longitudinal direction of the toner cartridge body 201 in the toner conveying passage 201*y*.

The paddle member 206 includes the rotary shaft 206*a* and one rectangular agitating blade 206*b* attached to the rotary shaft 206*a*.

One end of the rotary shaft 206*a* rotatably penetrates through the sidewall on one end side in the longitudinal direction of the toner cartridge body 201 in the toner storage section 201*x*, and a not-shown drive gear is attached to the one end.

Another end of the rotary shaft 206*a* is rotatably fitted into and supported by a recess provided in the sidewall on another end side in the longitudinal direction of the toner cartridge body 201 in the toner storage section 201*x*.

The agitating blade 206*b* is formed of a flexible sheet member such as a resin sheet (e.g., a PET sheet), a rubber sheet, or the like, which possesses appropriate combination of bendability and rigidity. A length of the agitating blade 206*b* is slightly shorter than that of the toner storage section 201*x*, and the agitating blade 206*b* is wide enough to slidingly contact with the bottom surface of the toner storage section 201.

A paddle member 206 loosens the toner T in the toner storage section 201*x* by the rotation of the rotary shaft 206*a* in an arrow E direction, and conveys the loosened toner T into the toner conveying passage 201*y*.

A toner inflow block member 205 is intended to block the toner T in the toner storage section 201*x* from flowing into the toner discharge section 204 passing through a clearance between the opening of the toner discharge section 204 opening toward the toner storage section 201*x* and the screw-shaped shaft 202, and includes a tip covering section that covers a portion of the screw-shaped shaft 202 and a flexible coupling section that couples the tip covering section to the rotary shaft 206*a* of the paddle member 206.

Specifically, the toner inflow block member 205 is made of a two-ply flexible sheet 205*a* or a single piece of twofold flexible sheet 205*a* such as a PET sheet.

One end of the two-ply flexible sheet 205*a* or a folded portion of the single piece of twofold flexible sheet 205*a* is coupled on the toner discharge port 204*a* side of the rotary shaft 206*a* of the paddle member 206 with screws 205*b* or the like, such that the flexible sheet 205*a* becomes adjacent to the agitating blade 206*b*.

As shown in FIGS. 3 and 6B (by a solid line), in a state before the cartridge body 201 is attached to the image forming apparatus, the tip covering section being each tip of the flexible sheet 205*a* that appears to be two sheets and that structures the toner inflow block member 205 is inserted into a curved clearance between the screw-shaped shaft 202 and the bottom surface of the toner conveying passage 201*y*, so as to wrap around the screw-shaped shaft 202 at a block position nearby the opening that opens toward the toner storage section 201*x* of the toner discharge section 204.

It is to be noted that, a portion of the flexible sheet 205*a* not being brought into contact with the screw-shaped shaft 202 is the flexible coupling section.

In this manner, the toner inflow block member 205 being disposed at the block position makes it difficult for the toner T to flow toward the opening of the toner discharge section 204 around the portion of the screw-shaped shaft 202 which is wrapped around by the toner inflow block member 205. As a result, the toner will not easily flow into the toner discharge section 204.

Accordingly, it becomes possible to solve the problem which is associated with the conventional toner cartridge in an unused state, the problem being that: the toner flows into the entire interior of the toner discharge section; the toner coagulates and forms a lump; the toner will not be discharged from the toner discharge section 204; and a locked phenomenon occurs, which hinders the rotation of the screw-shaped shaft 202.

As shown in FIG. 5, in a driving mode of the image forming apparatus after the cartridge body 201 is attached to the image forming apparatus, the paddle member 206 and the screw-shaped shaft 202 synchronously rotate, whereby the flexible coupling section between the tip covering section of the toner inflow block member 205 and the screws 205*b* rotates in the same direction. Thus, as shown in FIG. 6B (by a chain doubledashed line), the tip covering section pulled by the flexible coupling section comes off from the clearance of the block position.

That is, the toner inflow block member 205 leaves the block position. It is to be noted that, the arrow E direction indicates the rotation direction of the paddle member 206 and the toner inflow block member 205.

At this time, the agitating blade 206*b* of the paddle member 206 elastically deforms. The tip side thereof rotates while being slidably in contact with the inner wall surface of the cartridge body 201, so as to scoop the toner in the toner storage section 201 while loosening the toner, to convey the toner to the toner conveying passage 201*y*.

Further, the toner inflow block member 205 elastically deforms without interfering with the rotation of the agitating blade 206*b*, and rotates while being slidably in contact with the inner wail surface of the cartridge body 201. Furthermore, similarly to the agitating blade 206*b*, the toner inflow block member 205 scoops the toner in the toner storage section 201 while loosening the toner, to convey the toner to the toner conveying passage 201*y*.

Still further, the toner T in the toner conveying passage 201*y* is conveyed into the toner discharge section 204*a* by the screw-shaped shaft 202, and the toner T discharged from the toner discharge port 204*a* is replenished to the developing section 102 through the toner replenish pipe 105.

Second Embodiment

Figure 7:
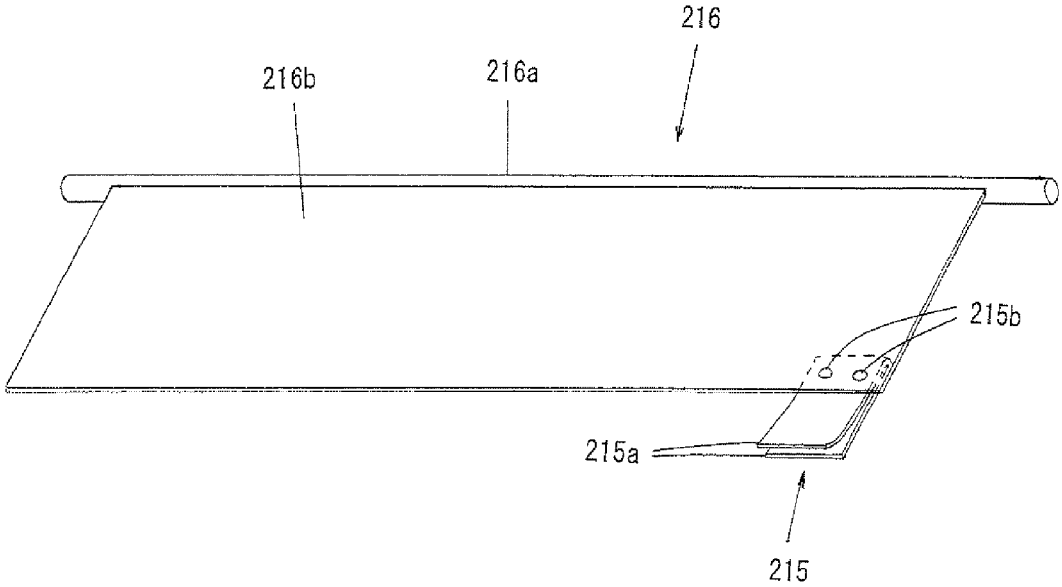
FIG. 7 is a perspective view showing a paddle member and a toner inflow block member according to a second embodiment of the present invention.

FIG. 7 is a perspective view showing a paddle member and a toner inflow block member according to a second embodiment of the present invention.

A toner cartridge according to the second embodiment is identical to that in the first embodiment, except that a toner inflow block member 215 is simplified than the toner inflow block member 205 according to the first embodiment.

In the following, a description will be given solely of differences in the second embodiment from the first embodiment.

In the first embodiment, what has exemplary been shown is the toner inflow block member 205 made of the two-ply flexible sheet 205*a* or the single piece of twofold flexible sheet 205*a* is coupled to the rotary shaft 206*a* of the paddle member 206 (see FIG. 4).

In this case, by the width in the axial direction of the flexible sheet 205*a*, the width in the axial direction of the agitating blade 206*b* of the paddle member 206 is shortened.

In the second embodiment, the width in the axial direction of the agitating blade 206*b* of the paddle member 206 is elongated by the length shortened in the first embodiment, and additionally, the toner inflow block member 215 is structured with a short two-ply flexible sheet 215*a* or a single piece of twofold flexible sheet 215*a*.

One end of the two-ply flexible sheet 215*a* or a folded portion of the single piece of twofold flexible sheet 215*a* is coupled to a tip of the agitating blade 216*b* on the toner discharge section side with screws 215*b* or the like.

With the toner inflow block member 215 structured as above, a portion protruding from the agitating blade 216*b* serves as the tip covering section, and a portion on the agitating blade 216 side serves as the flexible coupling section. Each tip of the flexible sheet 215*a*, which appears to be two sheets, of the tip covering section, is inserted into a curved clearance between the screw-shaped shaft and the bottom surface of the toner conveying passage, so as to wrap around the screw-shaped shaft at the block position, as in the first embodiment (see FIG. 6B).

The toner cartridge according to the second embodiment achieves the same operation and effect as those of the first embodiment.

Third Embodiment

Figure 8:
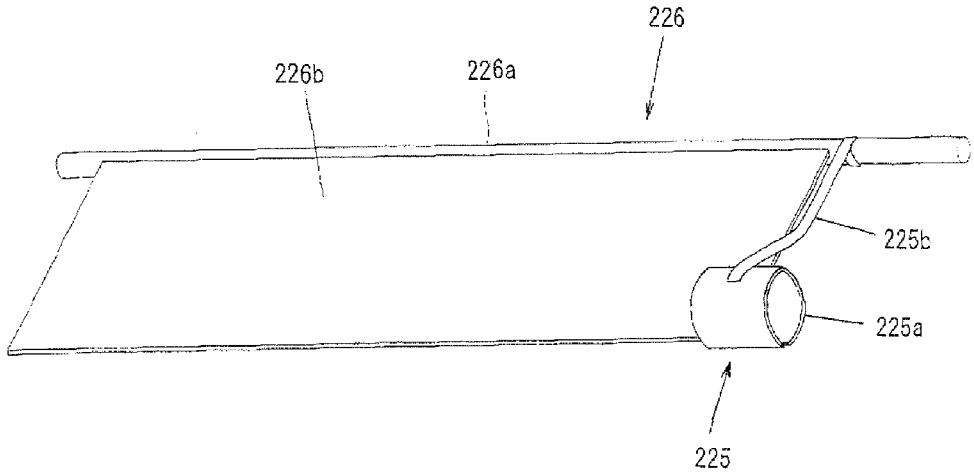
FIG. 8 is a perspective view showing a paddle member and a toner inflow block member according to a third embodiment of the present invention.
Figure 9A:
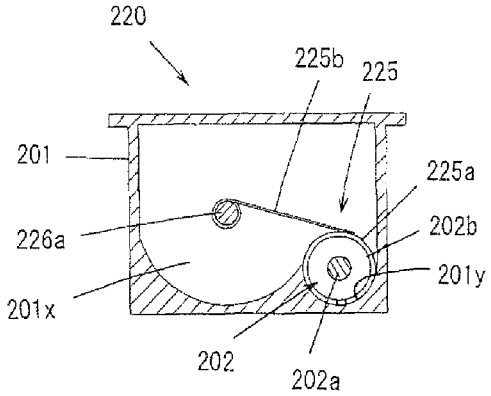
FIGS. 9A and 9B are cross-sectional views showing an unused state and a used state of a toner cartridge according to the second embodiment, respectively.
Figure 9B:
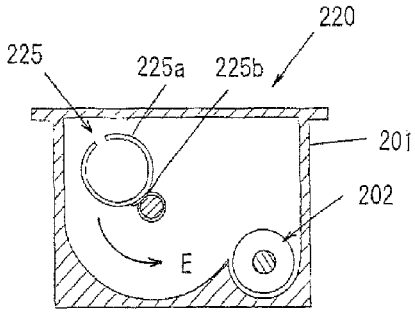
Figure 10:
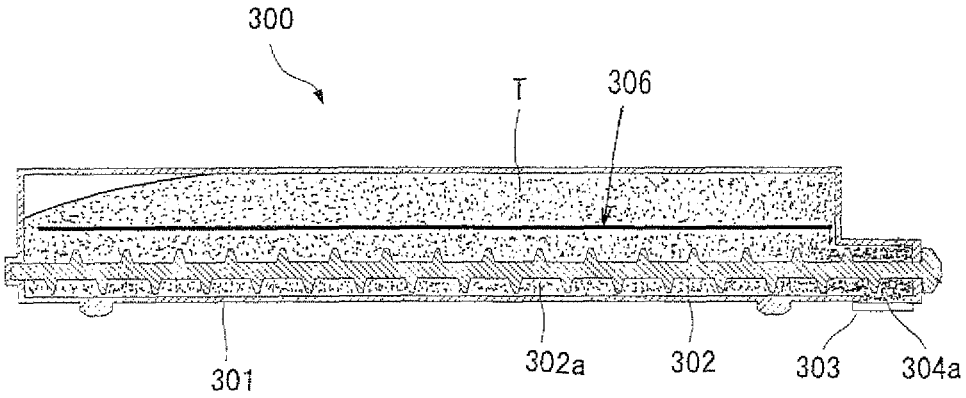
FIG.10 PRIOR ART
FIG. 10 is a side cross-sectional view before a conventional toner cartridge is attached to an image forming apparatus.

FIG. 8 is a perspective view showing a paddle member and a toner inflow block member according to a third embodiment of the present invention. FIGS. 9A and 9B are cross-sectional views showing an unused state and a used state of the toner cartridge according to the second embodiment. It is to be noted that, in FIGS. 9A and 9B, like elements as those in FIG. 6B are denoted by identical reference numerals.

A toner cartridge according to the third embodiment is identical to that according to the first embodiment, except that a toner inflow block member 225 is different from the toner inflow block member 205 according to the first embodiment.

In the following, a description will be given solely of differences in the third embodiment from the first embodiment.

In the third embodiment, in the toner inflow block member 225, the tip covering section is made of an elastic cap 225*a* having a C-shaped cross section, and the flexible coupling section is made of a tape 225*b* that couples the elastic cap 225*a* to a rotary shaft 226*a* of a paddle member 226.

It is to be noted that, as the elastic cap 225*a*, for example, a roll of plastic sheet can be used. Further, a strap can be used in place of the tape 225*b*.

As shown in FIG. 9A, in the unused state of the toner cartridge, the toner inflow block member 225 is disposed at the block position by the elastic cap 225*a* elastically deforming and to fitting to the screw-shaped shaft 202.

With the toner inflow block member 225, because the elastic cap 225*a* wraps around substantially the whole circumference of the screw-shaped shaft 202 near the opening of the toner discharge section 204, it becomes further difficult for the toner to flow into the toner discharge section 204 (see FIG. 3).

On the other hand, as shown in FIG. 9B, in a driving mode of the image forming apparatus, as the rotary shaft 226*a* of the paddle member 226 rotates in an arrow E direction, the tape 225*b* is taken up by the rotary shaft 226*a*, whereby the elastic cap 225*a* is pulled. Therefore, the elastic cap 225*a* elastically deforms and leaves the screw-shaped shaft 202, and is pulled toward the rotary shaft 226*a*.

At this time, the elastic cap 225*a* pulled toward the rotary shaft 226*a* rotates without interfering with the agitating blade 226*b*. It is to be noted that, when the diameter of the elastic cap 225*a* is smaller than a radius of gyration of the paddle member 226, the elastic cap 225*a* rotates without being slidably in contact with the inner wall surface of the cartridge body 201.

What is claimed is:

1. A toner cartridge, comprising:

a toner storage-purpose cartridge body that is formed as a hermetic container elongated in one direction, and that has a toner discharge port on an one end side in a longitudinal direction thereof;

a shutter provided on an outer surface side of the cartridge body for opening and closing the toner discharge port;

a screw-shaped shaft provided in the cartridge body rotatably about a rotation axis in the longitudinal direction for conveying a toner in the cartridge body to the toner discharge port;

a paddle member having in the cartridge body a rotary shaft being in parallel to the rotation axis of the screw-shaped shaft and an agitating blade attached to the rotary shaft, for conveying the toner in the cartridge body toward the screw-shaped shaft; and a toner inflow block member coupled to a portion of the paddle member, wherein the toner cartridge body includes a toner storage section being a large-capacity space where the paddle member is disposed and the toner is stored; and a toner conveying passage being a small-capacity space where the screw-shaped shaft is disposed, the toner conveying passage being adjacent to and communicating with the toner storage section and having the toner discharge port disposed on an one end side in a longitudinal direction of the toner conveying passage, the toner inflow block member is disposed at a block position where an inflow of the toner toward the toner discharge port is blocked, so as to cover a portion of the screw-shaped shaft in a state before the cartridge body is attached to an image forming apparatus, and rotates with the paddle member with the cartridge body attached to the image forming apparatus so as to be away from the block position;

wherein the toner inflow block member includes a tip covering section covering a portion of the screw-shaped shaft, and a flexible coupling section that couples the tip covering section to a rotary shaft of the paddle member; and wherein the toner inflow block member is made of a two-ply flexible sheet or a single piece of twofold flexible sheet, wherein by coupling one end of the two-ply flexible sheet or a folded portion of the single piece of twofold flexible sheet to the rotary shaft of the paddle member, a coupled end side of the flexible sheet appearing to be two sheets becomes the flexible coupling section, and a non-coupled end side becomes the tip covering section.

2. The toner cartridge according to claim 1, wherein the toner cartridge body is formed into a shape in which the toner conveying passage projects toward the one end side in the longitudinal direction farther than the toner storage section does, the toner discharge port is disposed in a projection space of the toner conveying passage projecting toward the one end side in the longitudinal direction farther than the toner storage section does, and the block position of the toner inflow block member is located at an opening of the projection space, the opening facing the toner storage section.

3. An image forming apparatus, comprising:

a photoconductor drum that is to have an electrostatic latent image formed on a surface thereof;

a developing section for supplying a toner to the electrostatic latent image on the surface of the photoconductor drum to form a toner image;

a toner cartridge according to claim 1 for supplying the toner to the developing section;

a transferring section for transferring the toner image on the surface of the photoconductor drum to a recording medium; and a fusing section for fusing the toner image on the recording medium.

4. A toner cartridge, comprising:

a toner storage-purpose cartridge body that is formed as a hermetic container elongated in one direction, and that has a toner discharge port on an one end side in a longitudinal direction thereof;

a shutter provided on an outer surface side of the cartridge body for opening and closing the toner discharge port;

a screw-shaped shaft provided in the cartridge body rotatably about a rotation axis in the longitudinal direction for conveying a toner in the cartridge body to the toner discharge port;

a paddle member having in the cartridge body a rotary shaft being in parallel to the rotation axis of the screw-shaped shaft and an agitating blade attached to the rotary shaft, for conveying the toner in the cartridge body toward the screw-shaped shaft; and a toner inflow block member coupled to a portion of the paddle member, wherein the toner cartridge body includes a toner storage section being a large-capacity space where the paddle member is disposed and the toner is stored; and a toner conveying passage being a small-capacity space where the screw-shaped shaft is disposed, the toner conveying passage being adjacent to and communicating with the toner storage section and having the toner discharge port disposed on an one end side in a longitudinal direction of the toner conveying passage, the toner inflow block member is disposed at a block position where an inflow of the toner toward the toner discharge port is blocked, so as to cover a portion of the screw-shaped shaft in a state before the cartridge body is attached to an image forming apparatus, and rotates with the paddle member with the cartridge body attached to the image forming apparatus so as to be away from the block position;

wherein the toner inflow block member includes a tip covering section covering a portion of the screw-shaped shaft, and a flexible coupling section that couples the tip covering section to a rotary shaft of the paddle member;

wherein the flexible coupling section is made of one end portion that extends in a radial direction of the agitating blade in the paddle member, the tip covering section is made of a two-ply flexible sheet or a single piece of twofold flexible sheet, and wherein one end of the two-ply flexible sheet or a folded portion of the single piece of twofold flexible sheet is coupled to a tip of the one end portion of the agitating blade.

5. The toner cartridge according to claim 4, wherein the toner cartridge body is formed into a shape in which the toner conveying passage projects toward the one end side in the longitudinal direction farther than the toner storage section does, the toner discharge port is disposed in a projection space of the toner conveying passage projecting toward the one end side in the longitudinal direction farther than the toner storage section does, and the block position of the toner inflow block member is located at an opening of the projection space, the opening facing the toner storage section.

6. An image forming apparatus, comprising:

a photoconductor drum that is to have an electrostatic latent image formed on a surface thereof;

a developing section for supplying a toner to the electrostatic latent image on the surface of the photoconductor drum to form a toner image;

a toner cartridge according to claim 4 for supplying the toner to the developing section;

a transferring section for transferring the toner image on the surface of the photoconductor drum to a recording medium; and a fusing section for fusing the toner image on the recording medium.

7. A toner cartridge, comprising:

a toner storage-purpose cartridge body that is formed as a hermetic container elongated in one direction, and that has a toner discharge port on an one end side in a longitudinal direction thereof;

a shutter provided on an outer surface side of the cartridge body for opening and closing the toner discharge port;

a screw-shaped shaft provided in the cartridge body rotatably about a rotation axis in the longitudinal direction for conveying a toner in the cartridge body to the toner discharge port;

a paddle member having in the cartridge body a rotary shaft being in parallel to the rotation axis of the screw-shaped shaft and an agitating blade attached to the rotary shaft, for conveying the toner in the cartridge body toward the screw-shaped shaft; and a toner inflow block member coupled to a portion of the paddle member, wherein the toner cartridge body includes a toner storage section being a large-capacity space where the paddle member is disposed and the toner is stored; and a toner conveying passage being a small-capacity space where the screw-shaped shaft is disposed, the toner conveying passage being adjacent to and communicating with the toner storage section and having the toner discharge port disposed on an one end side in a longitudinal direction of the toner conveying passage, the toner inflow block member is disposed at a block position where an inflow of the toner toward the toner discharge port is blocked, so as to cover a portion of the screw-shaped shaft in a state before the cartridge body is attached to an image forming apparatus, and rotates with the paddle member with the cartridge body attached to the image forming apparatus so as to be away from the block position;

wherein the toner inflow block member includes a tip covering section covering a portion of the screw-shaped shaft, and a flexible coupling section that couples the tip covering section to a rotary shaft of the paddle member;

wherein the tip covering section is made of an elastic cap having a C-shaped cross section, and the flexible coupling section is made of a strap or a tape.

8. The toner cartridge according to claim 7, wherein the toner cartridge body is formed into a shape in which the toner conveying passage projects toward the one end side in the longitudinal direction farther than the toner storage section does, the toner discharge port is disposed in a projection space of the toner conveying passage projecting toward the one end side in the longitudinal direction farther than the toner storage section does, and the block position of the toner inflow block member is located at an opening of the projection space, the opening facing the toner storage section.

9. An image forming apparatus, comprising:

a photoconductor drum that is to have an electrostatic latent image formed on a surface thereof;

a developing section for supplying a toner to the electrostatic latent image on the surface of the photoconductor drum to form a toner image;

a toner cartridge according to claim 7 for supplying the toner to the developing section;

a transferring section for transferring the toner image on the surface of the photoconductor drum to a recording medium; and a fusing section for fusing the toner image on the recording medium.

* * * * *